US008511107B2

(12) United States Patent
An et al.

(10) Patent No.: US 8,511,107 B2
(45) Date of Patent: Aug. 20, 2013

(54) REFRIGERATOR

(75) Inventors: Jae Koog An, Gwangju (KR); Sang Min Park, Gwangju (KR); Young Gwi Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/335,239

(22) Filed: Dec. 22, 2011

(65) Prior Publication Data

US 2012/0091166 A1 Apr. 19, 2012

Related U.S. Application Data

(63) Continuation of application No. 12/314,335, filed on Dec. 8, 2008, now Pat. No. 8,104,305.

(30) Foreign Application Priority Data

May 16, 2008 (KR) ..... 10-2008-0045249
Aug. 4, 2008 (KR) ..... 10-2008-0076041

(51) Int. Cl.
*F25D 3/00* (2006.01)

(52) U.S. Cl.
USPC ..... 62/389

(58) Field of Classification Search
USPC ..... 62/389, 338, 390, 440; 220/565, 220/371, 370; 210/240, 282, 295, 304; 222/189.06
See application file for complete search history.

(56) References Cited

U.S. PATENT DOCUMENTS

| | | | | | |
|---|---|---|---|---|---|
| 4,089,298 | A * | 5/1978 | Wilson | 119/201 |
| 4,255,937 | A * | 3/1981 | Ehrlich | 62/264 |
| 4,771,485 | A * | 9/1988 | Traylor | 4/678 |
| 5,135,645 | A * | 8/1992 | Sklenak et al. | 210/97 |
| 5,215,001 | A * | 6/1993 | Narcisi | 99/357 |
| 5,482,619 | A | 1/1996 | Chow | |
| 5,766,462 | A | 6/1998 | Jones | |
| 5,833,849 | A | 11/1998 | Primdahl | |
| 5,873,389 | A * | 2/1999 | Cheng | 137/801 |
| 5,907,958 | A | 6/1999 | Coates et al. | |
| 6,183,636 | B1 | 2/2001 | Bowers et al. | |
| 6,394,127 | B1 | 5/2002 | Creswell et al. | |
| 7,491,327 | B2 * | 2/2009 | Jenkins et al. | 210/232 |
| 2003/0024259 | A1 | 2/2003 | Jenkins et al. | |
| 2007/0144203 | A1 | 6/2007 | Kim et al. | |

FOREIGN PATENT DOCUMENTS

KR 10-2005-0051993 6/2005

OTHER PUBLICATIONS

U.S. Office Action mailed May 26, 2011 in U.S. Appl. No. 12/314,335.
U.S. Notice of Allowance mailed Sep. 26, 2011 in U.S. Appl. No. 12/314,335.
U.S. Appl. No. 12/314,335, filed Dec. 8, 2008, Jae Koog An et al., Samsung Electronics Co. LTD.

* cited by examiner

*Primary Examiner* — Mohammad M Ali
(74) *Attorney, Agent, or Firm* — Staas & Halsey LLP

(57) ABSTRACT

Disclosed is a refrigerator capable of purifying water discharged to a spout just before the water is dispensed. The refrigerator includes a spout, a water delivery system guiding water to the spout, and a water purification filter installed on the spout in order to purify the water just before the water is dispensed.

16 Claims, 7 Drawing Sheets

REFRIGERATOR

CROSS-REFERENCE TO RELATED APPLICATIONS

This application is a continuation of application Ser. No. 12/314,335 filed on Dec. 8, 2008, now U.S. Pat. No. 8,104,305 which claims the priority of Korean Patent Application No. 10-2008-0045249 filed on May 16, 2008, and Korean Patent Application No. 10-2008-0076041 filed on Aug. 4, 2008, where filed in the Korean Intellectual Property Office, the disclosures of which are incorporated herein by reference.

BACKGROUND

1. Field

Embodiments of the present invention relate to a refrigerator. More particularly, embodiments of the present invention relate to a refrigerator capable of purifying water discharged to a spout just before the water is dispensed.

2. Description of the Related Art

Among refrigerator, some are equipped with a water dispensing apparatus capable of dispensing drinking water in the front of a door or an ice maker capable of making ice in a storage compartment, particularly, in a freezing compartment. Typically, these refrigerators are equipped with a water dispensing system for dispensing the water to a spout formed in the front of the door or the ice maker provided in the freezing compartment, and a water purification filter for purifying the dispensed water. The water purification filter is installed in a refrigerating compartment.

However, these refrigerators are configured such that the water purified by the water purification filter is stored in a water tank disposed in the rear of a refrigerating compartment and then is delivered to the spout on the side of the door, and further, the refrigerator has a long water delivery path from the water purification filter to the spout of the door. Thus, in case a user does not take out the water from the spout on the side of the door for a long time, the water existing in the water delivery path between the water purification filter to the spout may change in quality. In other words, germs may proliferate in the water tank while the purified water is being stored in the water tank, thereby creating sanitary problems.

SUMMARY

Accordingly, it is an aspect of embodiments of the present invention to provide a refrigerator capable of purifying water discharged to a spout just before the water is dispensed.

Additional aspects and/or advantages of the invention will be set forth in part in the description which follows and, in part, will be apparent from the description, or may be learned by practice of the invention.

The foregoing and/or other aspects of embodiments of the present invention are achieved by providing a refrigerator, which includes a spout, a water delivery system for guiding water to the spout, and a water purification filter installed on the spout in order to purify the water just before the water is dispensed.

The refrigerator may further include a body having at least one storage compartment, a door opening and closing the at least one storage compartment, and a water dispensing space provided in the door. The spout is provided in the water dispensing space, and the water purification filter is held in the door.

The refrigerator may further include a filter holder provided in the door in order to hold the water purification filter, and a cover installed in a front of the door in order to open and close the filter holder.

The refrigerator may further include a body having at least one storage compartment, a door opening and closing the at least one storage compartment, and a water dispensing space provided in the door. The spout is provided in the water dispensing space, and the water purification filter is detachably mounted on the spout.

The water purification filter may include a discharge pipe expanding a channel through which the water purified by the water purification filter is discharged.

The discharge pipe is rotatable toward an outside of the water dispensing space in order to dispense the water on the outside of the water dispensing space.

The spout may include a filter socket for coupling and decoupling the water purification filter.

The refrigerator may further include a discharge pipe coupled to and decoupled from the filter socket so as to expand the channel of the spout. The discharge pipe is rotatable toward an outside of the water dispensing space.

The water dispensing space may include a filter holder in which the water purification filter is held.

The filter holder may be dented from one sidewall of the water dispensing space toward an outside of the water dispensing space.

The refrigerator may further include a filter cover enclosing and supporting the water purification filter held in the filter holder.

According to another aspect, embodiments of the present invention may provide a refrigerator, which includes a body having at least one storage compartment, a door, opening and closing the body, a water dispensing space provided in the door, a spout installed in the water dispensing space, water supply pipes installed in the body and in the door in order to deliver water to the spout, a first water purification filter, installed on the water supply pipes in a side of the body, in order to purify the water, and a second water purification filter detachably provided to the spout in order to purify the water just before the water is dispensed.

The second water purification filter may include a discharge pipe expanding a channel through which the water purified by the second water purification filter is discharged.

The discharge pipe may be rotatable toward an outside of the water dispensing space in order to dispense the water on the outside of the water dispensing space.

The refrigerator may further include a filter holder dented from one sidewall of the water dispensing space toward the outside of the water dispensing space such that the second water purification filter is held in the filter holder.

The spout may include a filter socket.

A discharge pipe may be configured to be mountable on the filter socket.

The discharge pipe may be configured to be able to rotate around the filter socket.

The filter holder may comprise an openable cover in the front thereof, facilitating access to exchange the second water purification filter.

The first water purification filter may filter fine particles, and the second water purification filter may filter bacteria.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
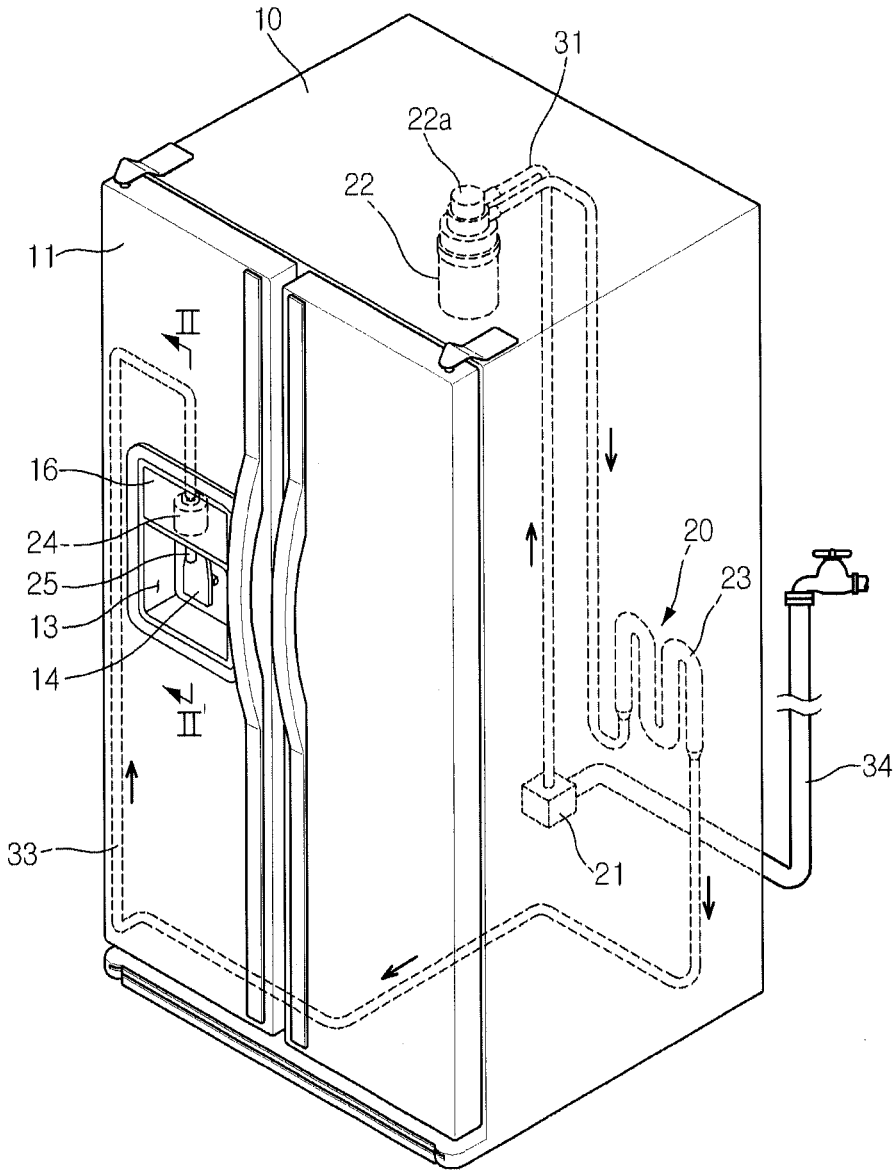
FIG. 1 is a perspective view illustrating a refrigerator according to an embodiment of the present invention.

Reference will now be made in detail to the embodiments of the present invention, examples of which are illustrated in the accompanying drawings, wherein like reference numerals refer to the like elements. The embodiments are described below to explain the present invention by referring to the figures.

First, the embodiments of the present invention are to provide a refrigerator capable of purifying water discharged to a spout just before the water is dispensed.

According to an embodiment of the present invention, as illustrated in FIG. 1, the refrigerator includes a body 10, an interior of which is partitioned into a left-hand freezing compartment (not shown) and a right-hand refrigerating compartment (not shown), and a freezing compartment door 11 and a refrigerating compartment door 12 installed on front opposite sides of the body 10 in order to open and close the freezing compartment and the refrigerating compartment, respectively. Although not shown in the figures, a cooling unit for cooling the freezing compartment and the refrigerating compartment is installed in the body 10. This cooling unit includes an evaporator, condenser, compressor, a refrigerant expansion device, etc. as in the ordinary refrigerator.

The freezing compartment door 11 is provided with a water dispensing space 13 that enables a user to draw water from the outside. The water dispensing space 13 is dented from the front to the rear of the freezing compartment door 11 at a predetermined depth. The example of FIG. 1 shows that the water dispensing space 13 is provided to the freezing compartment door 11. However, this water dispensing space 13 may be provided to the refrigerating compartment door 12.

Figure 2:
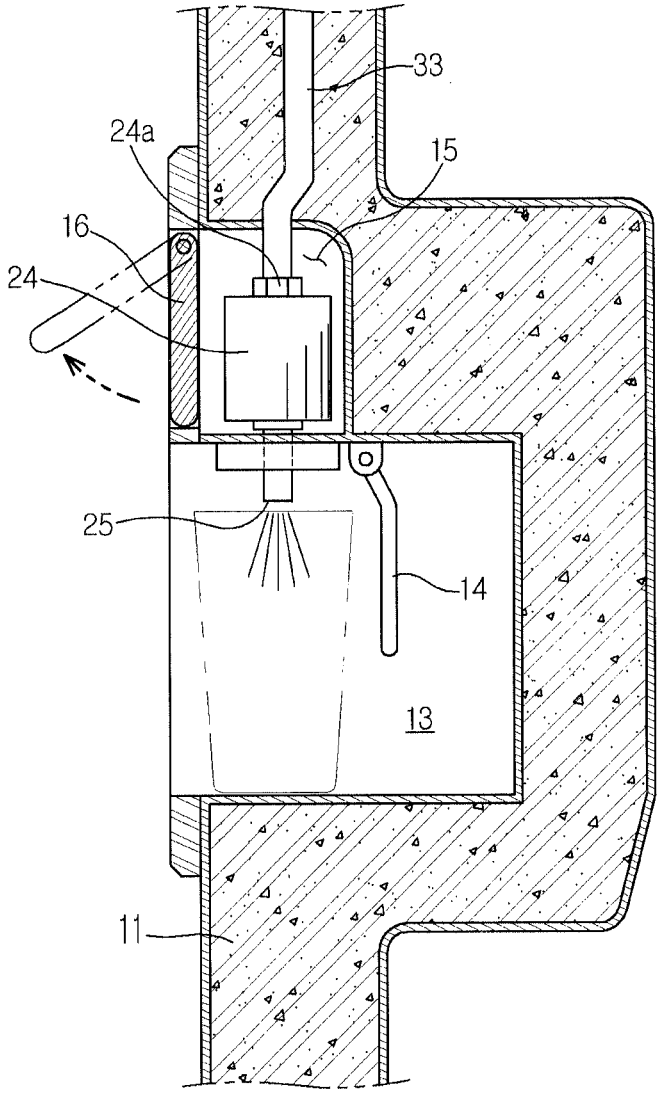
FIG. 2 is a cross-sectional view taken along the line II-II' of FIG. 1.

As illustrated in FIG. 2, a spout 25 through which the water is discharged may be installed on an upper portion of the water dispensing space 13. As illustrated in FIG. 1, the body 10 and the freezing compartment door 11 are provided with a water delivery system 20 for delivering the water to the spout 25. The water delivery system 20 may include first, second and third water supply pipes 31, 32 and 33 for guiding the water delivered from an external water delivery source, a water delivery valve 21 for regulating the delivery of the water, a water tank 23 for cooling the water, and first and second water purification filters 22 and 24 for purifying the water.

The water delivery valve 21 may be connected with the external water delivery source (e.g. a faucet) through a connecting pipe 34. The first water purification filter 22 may be detachably mounted on a filter socket 22*a*, which is installed, for instance, on an inner upper portion of the refrigerating compartment, and is connected with the water delivery valve 21 through the first water supply pipe 31. The water tank 23 may store a predetermined quantity of water purified by the first water purification filter 22. This water tank 23 may have an inlet connected with the first water purification filter 22 through the second water supply pipe 32, and an outlet connected with the spout 25 installed on the freezing compartment door 11 through the third water supply pipe 33. Further, the water tank 23 is installed in an inner rear portion of the refrigerating compartment in order to maintain the predetermined quantity of water purified by the first water purification filter 22 in a cooled state. To this end, the water tank 23 is exposed to cooled air of the refrigerating compartment, thereby maintaining the water in the cooled state. The first, second and third water supply pipes 31, 32 and 33, forming water delivery paths, are embedded in the body 10 and the freezing compartment door 11.

As illustrated in FIG. 2, the water dispensing space 13 is open to the front thereof such that the user can get a cup thereinto in front of the freezing compartment door 11 and thus draw the water. Further, a manipulation lever 14 is installed in the water dispensing space 13 so as to draw the water. The manipulation lever 14 is manipulated in such a manner that the user pushes the manipulation lever 14 when drawing the water. This manipulation lever 14 allows the water to be drawn by sending a water drawing signal to a controller (not shown) of the refrigerator and thus opening the water delivery valve 21 (FIG. 1), or can be implemented as a valve that directly opens and close the spout 25.

The spout 25 may be installed on the upper portion of the water dispensing space 13, and the second water purification filter 24 is installed on the upper portion of the water dispensing space 13 of the freezing compartment door 11 in line with the spout 25 so as to be able to purify the water just before the water is drawn. In this manner, in order to install the second water purification filter 24, the freezing compartment door 11 may be provided with a filter holder 15 that holds the second water purification filter 24. Further, the filter holder 15 includes an openable cover 16 in the front thereof. This configuration is to enable the user to open the cover 16 to exchange the second water purification filter 24 when the user intends to exchange the second water purification filter 24.

The second water purification filter 24 may be detachably connected to the third water supply pipe 33 embedded in the freezing compartment door 11 by a fastener 24*a*, which is installed on an upper portion of the second water purification filter 24. A pipe for the spout 25 extends from the second water purification filter 24 to the water dispensing space 13 in a downward direction. The pipe for the spout 25 is configured so that a separate pipe is coupled to the second water purification filter 24 or is integrally formed with the second water purification filter 24.

The second water purification filter 24 purifies the water just before the water is drawn, thereby allowing the water drawn through the spout 25 to be reliably purified. In other words, in the process in which the water is drawn, the second water purification filter 24 finally purifies the water once more. Even if the water is not drawn through the spout 25 for a long time, and thus germs may be proliferated in the water existing in the water tank 23 or the water supply pipes 32 and 33, this second water purification filter 24 finally purifies the water just before the water is drawn, and thereby can reliably purify the water which the user drinks.

The second water purification filter 24 preferably includes a filtration section having higher filtering density, compared to the first water purification filter 22. This is for more reliably purifying the water that is finally discharged. In this manner, when the filtering density of the second water purification filter 24 becomes high, an effect of purifying the water becomes high, while an exchange period of the filter can reduced. Nevertheless, since the user can open the cover 16 of the freezing compartment door 11 and then easily exchange the second water purification filter 24, there is no problem with the use. In order to increase the effect of purifying the water, it is good to frequently exchange the filter.

An embodiment of the present invention illustrates the case in which the first water purification filter 22 (FIG. 1) and the second water purification filter 24 are installed on the body 10 and the spout 25 in order to increase the effect of purifying the water, respectively. However, in this way, two water purification filters are not essentially required. For example, the discharged water may be purified by only one water purification filter (second water purification filter 24) installed on the spout 25. In other words, the water discharged through the spout 25 can be reliably purified by the second water purification filter 24 alone.

Figure 3:
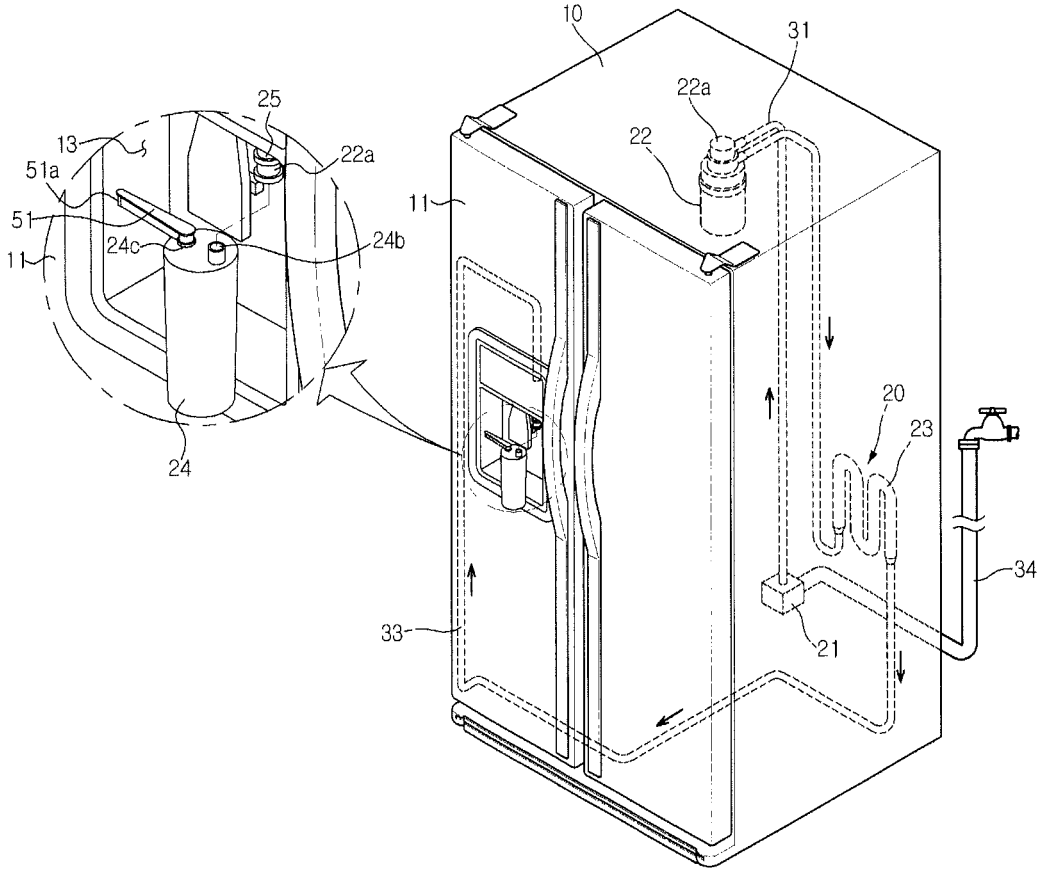
FIG. 3 is a perspective view illustrating a refrigerator according to an embodiment of the present invention.
Figure 4:
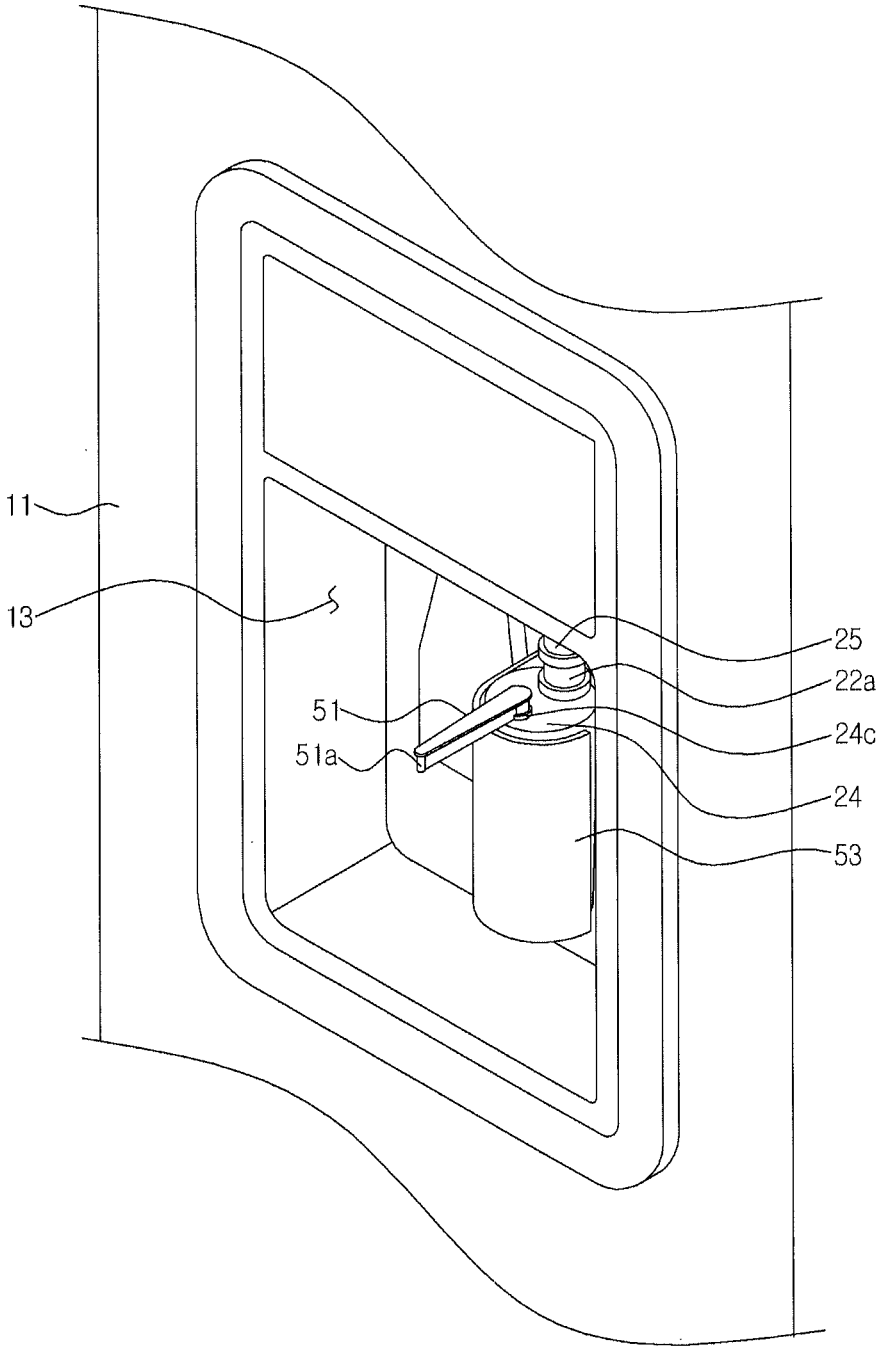
FIG. 4 is a perspective view illustrating the state in which a water purification filter is mounted in a water dispensing space according to an embodiment of the present invention.

FIGS. 3 and 4 illustrate another embodiment in which a second water purification filter is mounted in a water dispensing space.

As illustrated in FIG. 3, the spout 25 may be installed adjacent to the upper portion of a sidewall of the water dispensing space 13, and the spout 25 is provided with a filter socket 22*a* for detachably mounting the second water purification filter 24 that is a filter for eliminating bacteria. Thus, it is not necessary to separately provide the filter holder 15 (FIG. 2) to the freezing compartment door 11 in order to install the second water purification filter 24. As a result, the configuration of the freezing compartment door 11 is simplified, and simultaneously the exchange of the second water purification filter 24 is made easier.

Further, the second water purification filter 24 may be a filter for eliminating bacteria as illustrated in FIG. 3, including an inlet 24*b* inserted into the filter socket 22*a*, and an outlet 24*c* through which the water purified by the second water purification filter 24 is discharged. This outlet 24*c* is coupled with a discharge pipe 51, which can be rotated in the water dispensing space 13 in every direction.

One end of the discharge pipe 51 is coupled to the outlet 24*c* of the second water purification filter 24, and the other end of the discharge pipe 51 is provided with a discharge hole 51*a* through which the purified water is discharged to the outside. As illustrated in FIG. 4, this discharge pipe 51 is installed so as to be able to rotate around the outlet 24*c* of the second water purification filter 24, so that the water can be discharged into a cup, which may be bigger, and thus not fit into the water dispensing space 13.

Further, the second water purification filter 24 may be provided with a filter cover 53 in the front thereof which prevents the second water purification filter 24 from being exposed to the outside.

Figure 5:
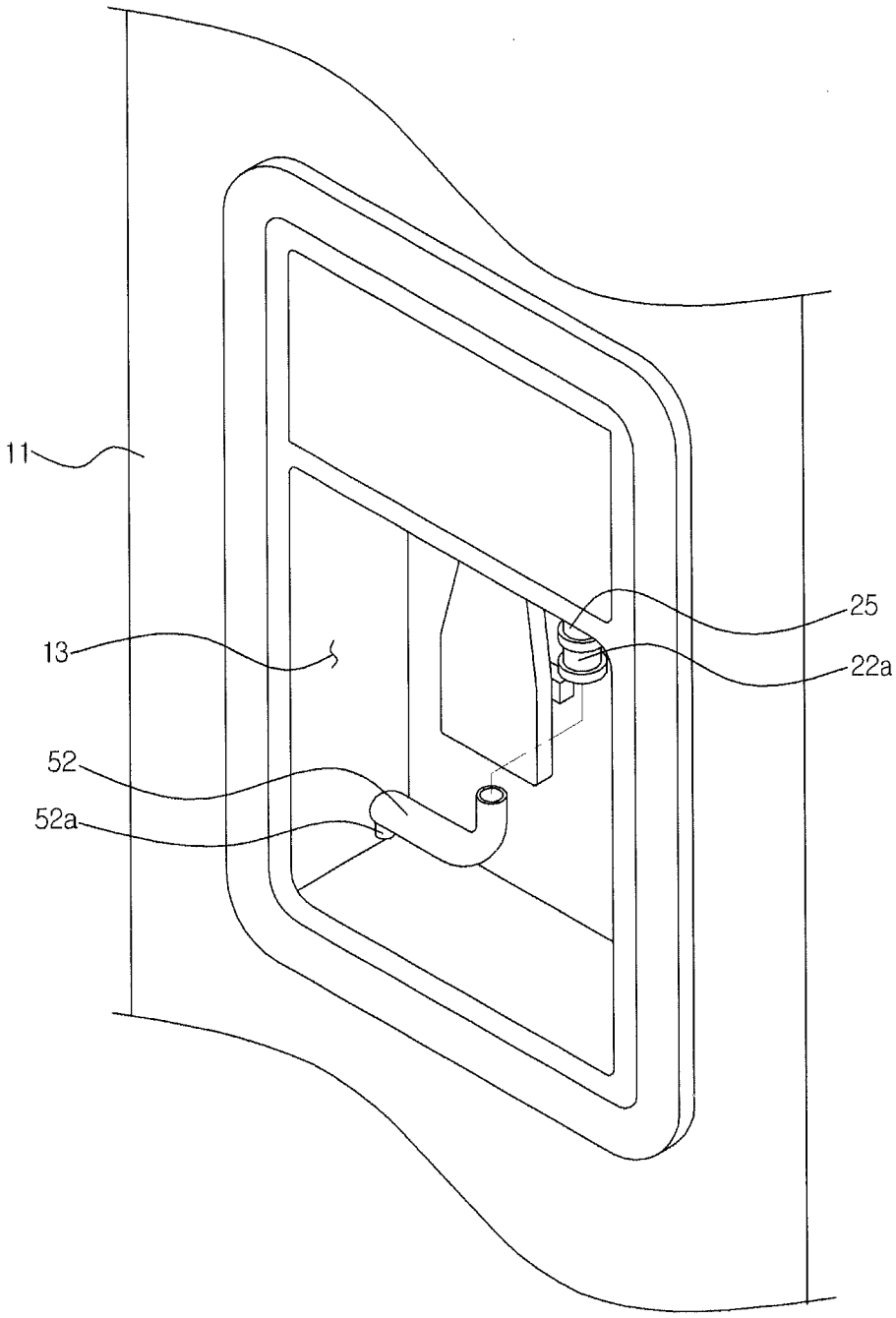
FIG. 5 is a perspective view illustrating the state in which a discharge pipe expanding the channel of a spout is mounted on the spout according to an embodiment of the present invention.

Also, when the user does not use the second water purification filter 24 according to circumstances, a discharge pipe 52 having a discharge hole 52*a* can be mounted on the filter socket 22*a* when used, as illustrated in FIG. 5. This discharge pipe 52 is also configured to be able to rotate around the filter socket 22*a* in every direction, so that the water can be discharged into the cup that has difficulty in accessing the water dispensing space 13.

Thus, the refrigerator according to an embodiment of the present invention can filter fine particles such as suspended solids using the first water purification filter 22 (FIG. 3) and thus prevent contaminants from being deposited on the water delivery system 20. Further, the refrigerator can reliably purify the water which the user drinks by finally purifying the water just before the water is discharged using the second water purification filter 24 that is a filter for eliminating bacteria, which may proliferate in the water tank 23 and the water supply pipes 32 and 33 while the user uses the refrigerator for a long time without dispensing water.

Further, when the user does not require the second water purification filter 24 that is a filter for eliminating bacteria, the second water purification filter 24 can be removed, and then the discharge pipe 52 can be mounted on the filter socket 22*a* when used (see FIG. 5). Thus, the convenience of use is improved as well.

Figure 6:
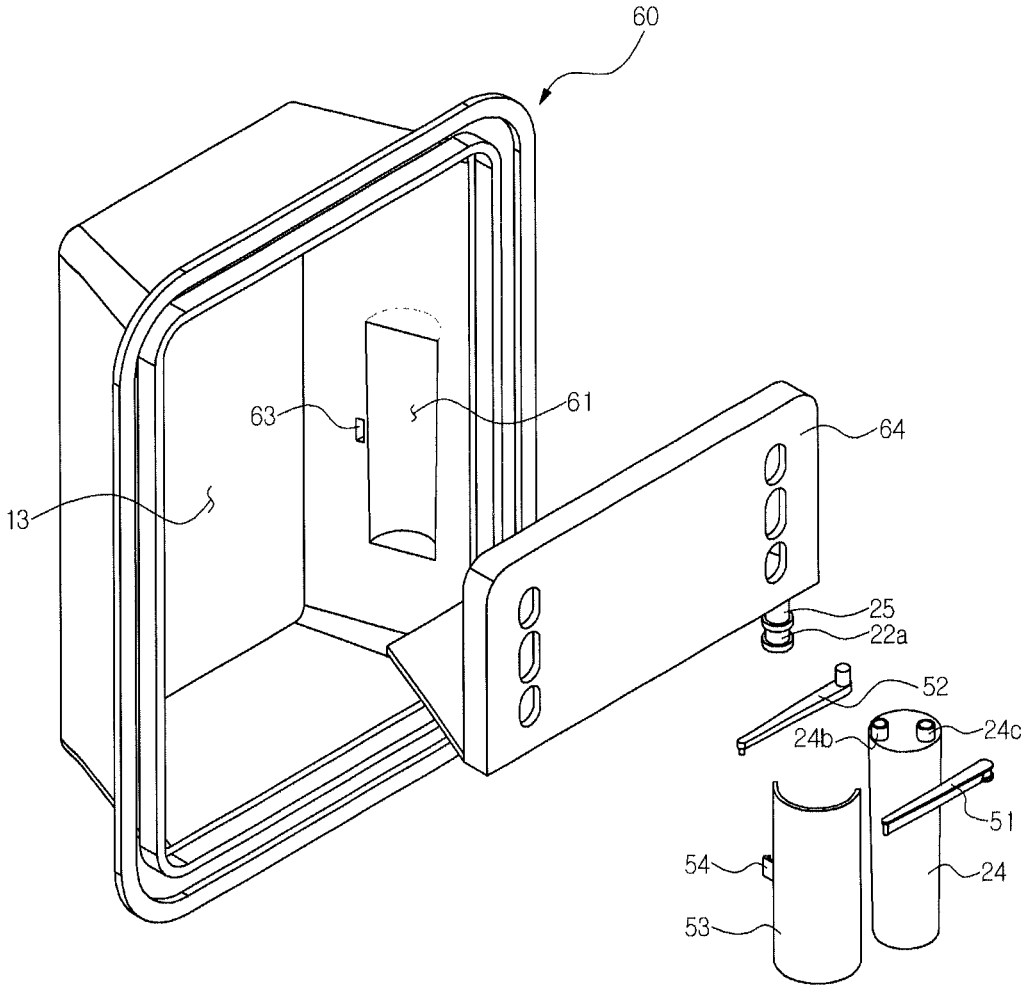
FIG. 6 is an exploded perspective view illustrating the state in which a water purification filter is mounted in a water dispensing space according to an embodiment of the present invention.
Figure 7:
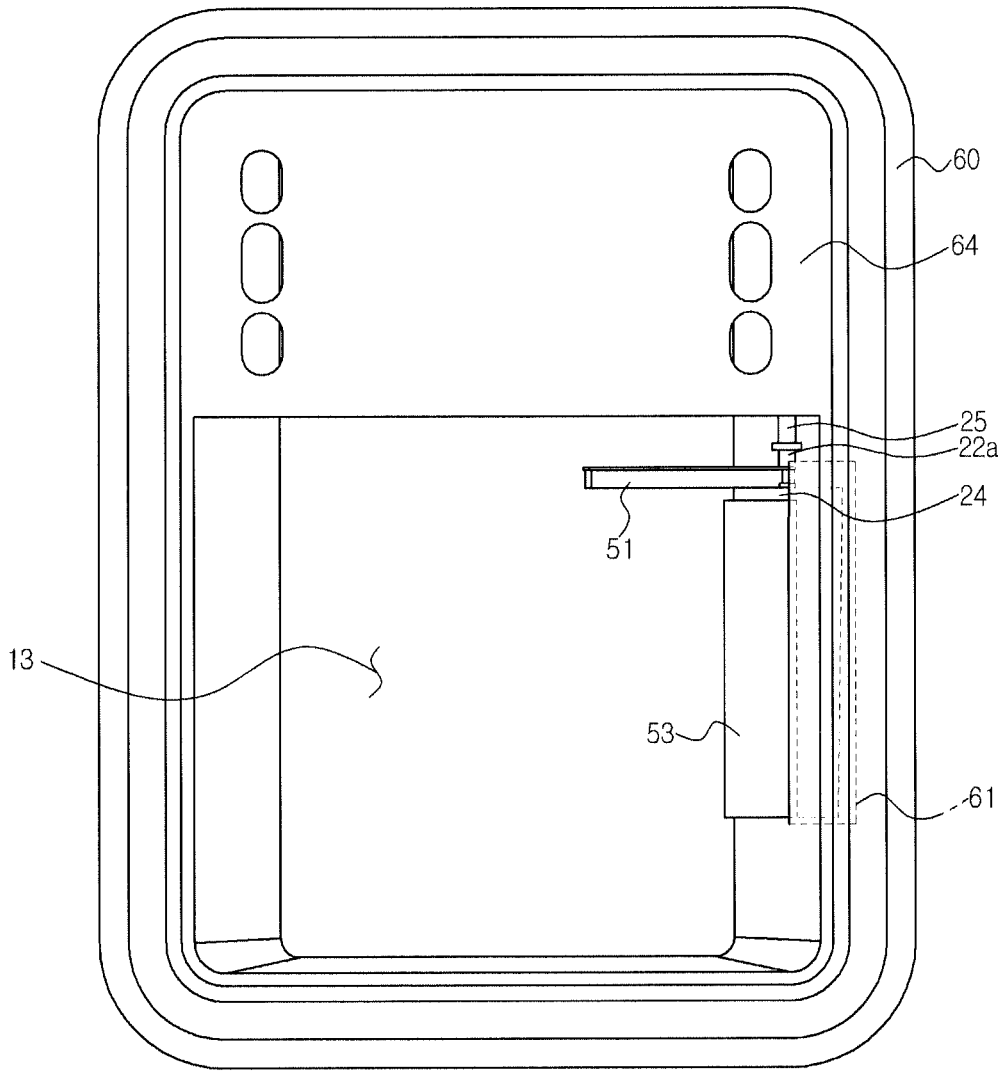
FIG. 7 is a front view illustrating the state in which a water purification filter is mounted in a water dispensing space according to an embodiment of the present invention.

FIGS. 6 and 7 illustrate an embodiment of the present invention in which a second water purification filter is mounted in a water dispensing space. Hereinafter, in this embodiment, like reference numerals are given to the like elements having similar functions as in the aforementioned embodiment, and thus a detailed description thereof will be omitted.

As illustrated in FIG. 6, a dispenser is installed on the freezing compartment door 11 (FIG. 3), and includes a case 60 having the water dispensing space 13 capable of discharging water.

A front plate 64 is installed on a front upper portion of the case 60. The spout 25 protrudes downwardly from the front plate 64 adjacent to one sidewall of the case 60 having the water dispensing space 13.

The spout 25 protruding from the water dispensing space 13 is provided with a filter socket 22*a* for coupling and decoupling the second water purification filter 24 or the discharge pipe 52.

The one sidewall of the case 60 neighboring the spout 25 is provided with a filter holder 61, which is dented from one sidewall of the case 60 toward the outside of the water dispensing space 13 corresponding to a shape of the second water purification filter 24 such that the second water purification filter 24 is placed in the filter holder 61.

The second water purification filter 24 is held in this filter holder 61, so that spatial waste of the water dispensing space 13 caused by the second water purification filter 24 can be reduced, and thus spatial utility of the water dispensing space 13 can be improved.

In the state in which the second water purification filter 24 is held in the filter holder 61, the inlet 24*b* and outlet 24*c* of the second water purification filter 24 are exposed to the water dispensing space 13. Thereby, the inlet 24*b* of the second water purification filter 24 is coupled with the filter socket 22*a* installed on the spout 25. Further, outlet 24*c* may be coupled with a discharge pipe 51, which can be rotated in the water dispensing space 13.

The second water purification filter 24 protruding toward the water dispensing space 13 can be enclosed by a filter cover 53. To this end, the case 60 is provided with a hooking recess 63, and the filter cover 53 is provided with a hook 54 hooked into the hooking recess 63.

When the second water purification filter 24 is held in the filter holder 61, this filter cover 53 supports an outer surface of the second water purification filter 24, and thus prevents the second water purification filter 24 from being separated from the filter holder 61.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a storage compartment;

a door configured to open and close the storage compartment;

a spout to discharge water to a water dispensing region provided in the door;

a water tank configured to cool water supplied from an external water source;

a water delivery system configured to guide water from the water tank to the spout; and a water purification filter coupled to the water delivery system between the water tank and the spout to purify the water supplied from the water tank before the water is dispensed, wherein the water purification filter is disposed in an outer portion of the door, accessible from outside of the refrigerator.

2. The refrigerator as claimed in claim 1, further comprising another water purification filter disposed between the external water source and the water tank.

3. The refrigerator as claimed in claim 1, further comprising a filter containing region provided in the outer portion of the door to contain the water purification filter, and a cover installed in a front of the door in order to open and close the filter containing region.

4. The refrigerator as claimed in claim 1, wherein the water purification filter is detachably mounted to the spout.

5. The refrigerator as claimed in claim 4, wherein the water purification filter includes a discharge pipe expanding a channel through which the water purified by the water purification filter is discharged.

6. The refrigerator as claimed in claim 5, wherein the discharge pipe is rotatable toward an outside of the water dispensing space in order to dispense the water on the outside of the water dispensing space.

7. The refrigerator as claimed in claim 4, wherein the spout includes a filter socket for coupling and decoupling the water purification filter.

8. The refrigerator as claimed in claim 7, further comprising a discharge pipe coupled to and decoupled from the filter socket so as to expand the channel of the spout, wherein the discharge pipe is rotatable toward an outside of the water dispensing space.

9. The refrigerator as claimed in claim 4, wherein the water dispensing space includes a filter holder in which the water purification filter is held.

10. The refrigerator as claimed in claim 9, wherein the filter holder is dented from one sidewall of the water dispensing space toward an outside of the water dispensing space.

11. The refrigerator as claimed in claim 9, further comprising a filter cover enclosing and supporting the water purification filter held in the filter holder.

12. A refrigerator comprising:

a body having a storage compartment;

a door configured to open and close the storage compartment;

a spout to discharge water to a water dispensing region provided in the door;

a water tank configured to cool water supplied from an external water source;

a water delivery system configured to guide water from the water tank to the spout; and a water purification filter coupled to the spout to purify the water supplied from the water tank before the water is dispensed, wherein the water purification filter includes an outlet disposed on an outer surface of the water purification filter and a discharge pipe coupled to the outlet extending in a radial direction from the water purification filter, wherein the discharge pipe is rotatable about the water purification filter and dispenses water outside of the refrigerator.

13. A refrigerator comprising:

a body having a storage compartment;

a door configured to open and close the storage compartment;

a case installed in a front portion of the door to provide a water dispensing region;

a spout to discharge water to the water dispensing region, the spout protruding in a downward direction from an upper portion of the case;

a water tank configured to cool water supplied from an external water source;

a water delivery system configured to guide water from the water tank to the spout; and a water purification filter coupled to the spout to purify the water supplied from the water tank before the water is dispensed, wherein the water purification filter is disposed in a dented portion of a wall of the case which is adjacent to the spout.

14. The refrigerator as claimed in claim 13, wherein the spout includes a filter socket used to couple and decouple the water purification filter.

15. The refrigerator as claimed in claim 14, wherein the water purification filter includes an outlet disposed on an outer surface of the water purification filter and a discharge pipe coupled to the outlet extending in a radial direction from the water purification filter, and an inlet used to couple and decouple the filter socket.

16. The refrigerator as claimed in claim 13, wherein the water purification filter is positioned in the dented portion of the sidewall of the case such that a portion of the water purification filter does not protrude into the water dispensing region.

* * * * *